US008094831B2

(12) United States Patent
Feit

(10) Patent No.: US 8,094,831 B2
(45) Date of Patent: Jan. 10, 2012

(54) SUPPLEMENTAL AUDIO OUTPUT BOX

(75) Inventor: Steven Feit, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 1054 days.

(21) Appl. No.: 11/960,793

(22) Filed: Dec. 20, 2007

(65) Prior Publication Data

US 2009/0110211 A1 Apr. 30, 2009

Related U.S. Application Data

(60) Provisional application No. 60/982,536, filed on Oct. 25, 2007.

(51) Int. Cl.
*H04R 1/00* (2006.01)

(52) U.S. Cl. ..... 381/86

(58) Field of Classification Search ..... 381/86, 381/302, 80, 81, 300, 332; 455/344, 345, 455/347, 350; 701/1, 2, 36; 725/75, 38, 725/59, 77

See application file for complete search history.

(56) References Cited

U.S. PATENT DOCUMENTS

| | | | | |
|---|---|---|---|---|
| 6,246,935 | B1 | 6/2001 | Buckley | |
| 6,330,337 | B1 * | 12/2001 | Nicholson et al. | 381/86 |
| 2001/0048749 | A1 * | 12/2001 | Ohmura et al. | 381/86 |
| 2002/0084910 | A1 | 7/2002 | Owens et al. | |
| 2005/0099495 | A1 | 5/2005 | Vitito | |
| 2006/0041351 | A1 | 2/2006 | Amano et al. | |
| 2006/0044214 | A1 * | 3/2006 | Hong | 345/1.1 |
| 2006/0044947 | A1 * | 3/2006 | Chia | 369/29.02 |
| 2008/0175405 | A1 * | 7/2008 | Couvillon | 381/86 |

FOREIGN PATENT DOCUMENTS

WO WO2006052297 5/2006

* cited by examiner

*Primary Examiner* — Dao H Nguyen
*Assistant Examiner* — Tram H Nguyen
(74) *Attorney, Agent, or Firm* — Mark E. Duell, Esq.; Emerson Thomson Bennett

(57) ABSTRACT

An audio system for a motor vehicle is provided, including an audio head unit that generates an audio signal. One or more external speakers are provided that receive the audio signal and produce an acoustic output within the motor vehicle. A supplemental output interface receives the audio signal through a hard-wired connection to the audio head unit. The supplemental output interface comprising at least one output speaker connection, for providing a removable speaker connection.

20 Claims, 3 Drawing Sheets

SUPPLEMENTAL AUDIO OUTPUT BOX

The present application claims priority to U.S. Provisional Patent Application No. 60/982,536 filed Oct. 25, 2007 now pending, and incorporates such application herein by reference in its entirety.

I. BACKGROUND OF THE INVENTION

A. Field of Invention

This invention pertains to methods and apparatuses regarding audio systems for vehicles. More specifically, the invention pertains to audio systems that enable the expansion and addition of audio components and also upgrading to higher quality or performance audio components.

B. Description of the Related Art

Audio entertainment systems for motor vehicles are well known in the art for providing music and other audio enjoyment to a driver and passengers while riding in a motor vehicle. Some automobile owners wish to modify their vehicle's audio system, to either add additional components such as side speakers or subwoofers, or to upgrade or customize the existing speaker components installed at the factory. However, such modifications require removal of trim panels in the dashboard, and require splicing into the wire harness of the existing audio unit. This can be difficult, especially for the vehicle owner who may not have the experience and the tools of a professional installer.

In order to overcome these difficulties, methods and apparatuses would be needed that would simplify the installation of additional automotive audio output components, and would allow easier upgrading of existing components, particularly if such upgrading would require installing heavier gage wiring to support additional power requirements.

II. SUMMARY OF THE INVENTION

Some embodiments of the present invention relate to an audio system for a motor vehicle, including an audio head unit that generates an audio signal. One or more external speakers are provided that receive the audio signal and produce an acoustic output within the motor vehicle. A supplemental output interface receives the audio signal through a hard-wired connection to the audio head unit. The supplemental output interface comprising at least one output speaker connection, for providing a removable speaker connection.

Other embodiments of the invention relate to a supplemental output interface for an audio system for a motor vehicle that can include means for receiving an audio signal from an audio head unit in the motor vehicle. One or more output speaker connection means are provided for removably connecting to one or more external speakers and for sending the audio signal to the external speaker to produce an acoustic output.

Still other embodiments of the invention relate to methods of installing a supplemental output interface to an audio system for a motor vehicle, including steps of providing an audio head unit in the motor vehicle for generating an audio signal, connecting a supplemental output interface to receive the audio signal, and removably connecting an external speaker to the supplemental output interface.

One advantage of this invention is that it provides an audio entertainment system for a motor vehicle that can be easily modified.

Another advantage of this invention is it allows speakers to be upgraded or customized without requiring removal of trim panels in the dashboard.

Still another advantage of this invention is that modification can be performed without splicing into the wire harness from the existing audio unit.

Yet another advantage of this invention is that modification can be done by a vehicle owner without requiring the experience or the tools of a professional installer.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

The present invention generally relates to audio systems for motor vehicles and methods for installing the same, so as to enable additional speakers to be added without removing components from the dashboard or cutting into the wiring harness to gain access to the audio head unit.

Various embodiments are disclosed herein below that provide details of an audio system including a supplemental output interface. In one embodiment, the supplemental output interface provides audio connections to an amplifier for auxiliary speakers, such and left and right channels and/or a subwoofer. In another embodiment, a power access is provided for supplying power from a vehicle battery through the supplemental output interface to the amplifier. An additional embodiment shows a plurality of supplemental output interfaces connecting with amplifiers and speakers in various locations of the vehicle. In yet another embodiment, a supplemental output interface is used for making the primary speaker connections in the motor vehicle.

Figure 1:
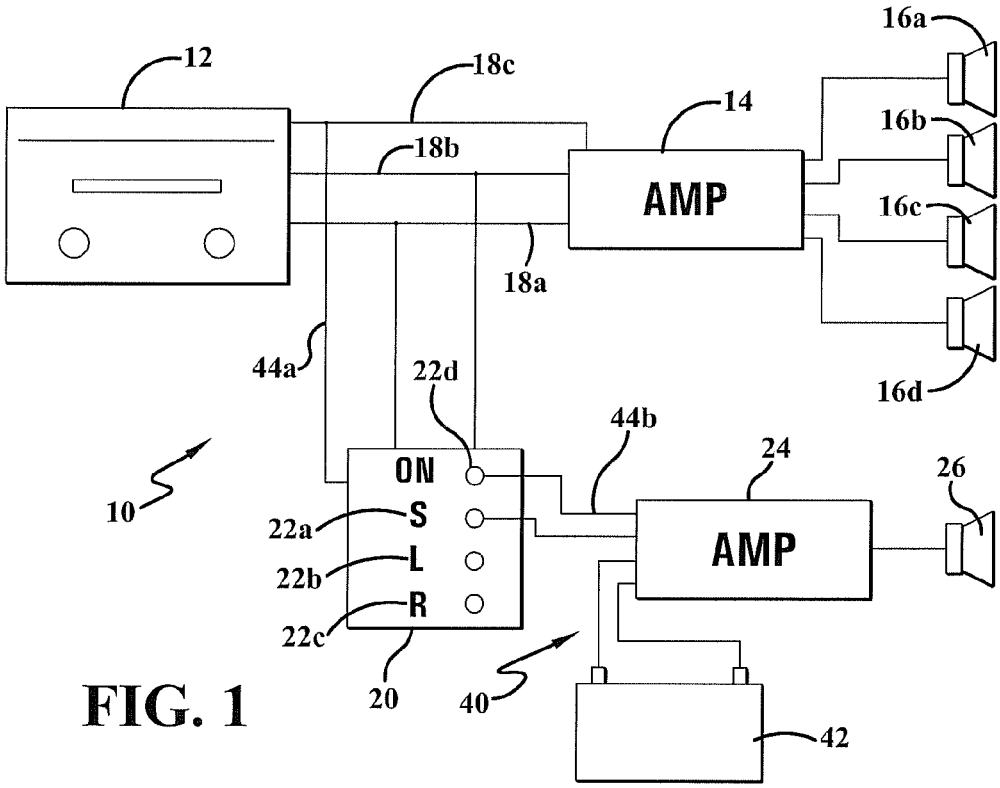
FIG. 1 is a schematic view depicting an audio system having a supplemental output interface in accordance with an embodiment of the present invention.

We refer now to the drawings herein the showings are for purposes of illustrating embodiments of the invention only and not for purposes of limiting the same, and wherein like reference numerals are understood to refer to like components. FIG. 1 shows an audio system 10 for a motor vehicle. An audio head unit 12 is provided that generates an audio signal. It is to be appreciated that the audio head unit 12 can be any suitable audio component such as a radio tuner for receiving radio signals. The audio head unit 12 can also include a player for playing any recorded medium, such a compact disc player, an audio tape player, or a player for a digitally recorded audio file, such as an MP3 player or the like.

As part of the audio system 10, the audio head unit 12 sends audio signals to an amplifier 14 that sends amplified audio signals to one or more external speakers, which produce an acoustic output within the motor vehicle for the listening enjoyment of the vehicle driver and passengers. In an exemplary embodiment shown in FIG. 1, the external speakers can be configured to output left and right stereo channels, in the front and rear areas of the vehicle. A typical speaker arrangement can include a front left speaker 16*a*, a front right speaker 16*b*, a rear left speaker 16*c*, and a rear right speaker 16*d*.

Electrical signal connections are provided between the audio head unit 12 and the amplifier 14, including a wiring harness having a left channel wire pair 18*a*, a right channel wire pair 18*b* and an amplifier on/off line 18*c* for actuating and de-actuating the amplifier 14 in response to a user depressing a "power" button.

A supplemental output interface 20 is provided that receives the audio signal from the audio head unit 12. The supplemental output interface 20 preferably includes a hard-wired connection to the audio head unit 12. This connection may be established in the factory during the assembly of the motor vehicle. However, it is also contemplated that a supplemental output interface may be installed onto an existing vehicle as an aftermarket item, to allow a vehicle owner to easily make one or more upgrades throughout the life of the vehicle.

The supplemental output interface 20 includes one or more output speaker connections, for providing removable connections 22*a*, 22*b*, 22*c* to a respective number of speakers. As shown in FIG. 1, the connections can include a subwoofer connection 22*a*, a left channel connection 22*b*, and a right channel connection 22*c*. These removable connections 22*a*, 22*b*, 22*c* allow respective wires to be run to a supplemental amplifier 24, and then to a supplemental speaker 26, e.g., a subwoofer, as illustrated in FIG. 1.

Figure 5:
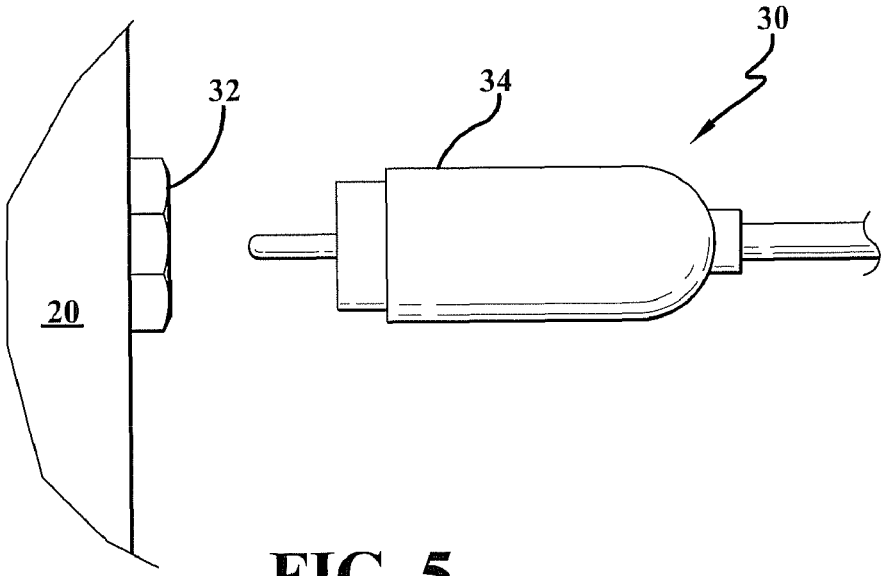
FIG. 5 is a side view depicting a preferred embodiment of a removable connection for an audio system including a supplemental output interface, in accordance with the present invention.

The removable connections as described herein are preferably any suitable type of cable having a plug configured to receive a jack with a cable connecting to a respective device. As shown in FIG. 5, the output speaker connection 30 preferably comprises an RCA plug 32 for receiving an RCA jack 34. Preferably, the RCA plug 32 is mounted on the exterior surface of the supplemental output interface 20 and the RCA jack 34 is connected to a coaxial cable for running to the supplemental amplifier 24. However, it is to be appreciated that any other suitable type of connector plug and jack, for coaxial or multiple lead cables, for analog or digital audio signals, could alternatively be employed, such as SMA, TRS, DIN, XLR, TOSLINK, HIDMI, or the like, without departing from the invention.

Turning back to FIG. 1, the supplemental amplifier 24 includes an electrical power connection 40 for receiving electrical power from the vehicle battery 42. These can be separate power leads wired directly into the vehicle fuse box (not shown), or they can be a removable plug/jack-type connection from the fuse box to the supplemental amplifier 24. An amplifier on/off line has a first portion 44*a* electrically connected to the amplifier on/off line 18*c* from the audio head unit 12 to the supplemental output interface 20, and has a second portion 44*b* for connecting to the amplifier 24. This also actuates and de-actuates the supplemental amplifier 24 in response to a user depressing a "power" button, so that all the speakers in the audio system 10 turn off in unison. The supplemental output interface 20 also include a "power on" indicator light 22*d* to indicate an "on" state.

As shown in FIG. 1, the battery connection 40 can be established directly from the vehicle battery 42 to the amplifier 24. However, in an alternate embodiment illustrated in FIG. 2, the supplemental output interface 20 can be configured to receive a battery connection 40*a* and extend a power connection 40*b* to the supplemental amplifier 24. An amplifier on/off line 44 is electrically connected to the amplifier on/off line 18*c* from the audio head unit 12 and is configured to actuate and de-actuate power to the supplemental amplifier 24 by operating a switch internally within the supplemental output interface 20. In this way, the supplemental output interface 20 can selectively supply amplifier power in addition to audio signals from the audio head unit 12.

Figure 2:
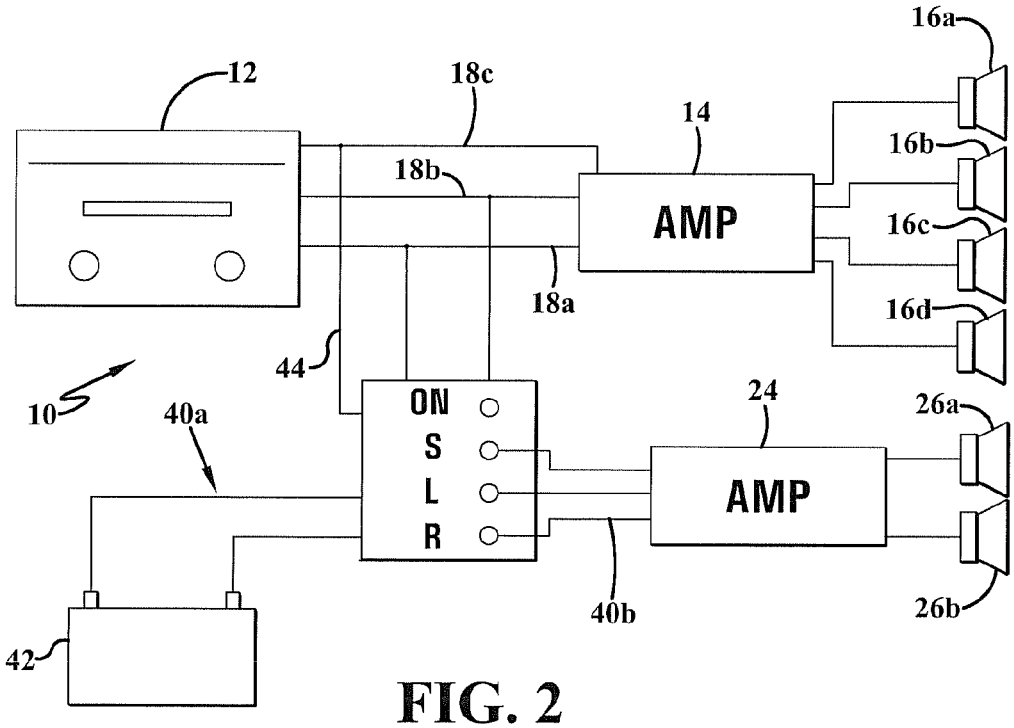
FIG. 2 is a schematic view illustrating an audio system including a supplemental output interface having an electrical connection to the vehicle battery in accordance with another embodiment of the present invention.

The embodiment of FIG. 2 also depicts an arrangement where the supplemental amplifier 24 receives audio signals from the left and right channels and outputs these signals through respective left and right speakers 26*a*, 26*b*. This is different than the embodiment of FIG. 1 which only shows a subwoofer 26. Of course, it is to be appreciated that any number and combination of speakers can be implemented without departing from the invention.

Figure 3:
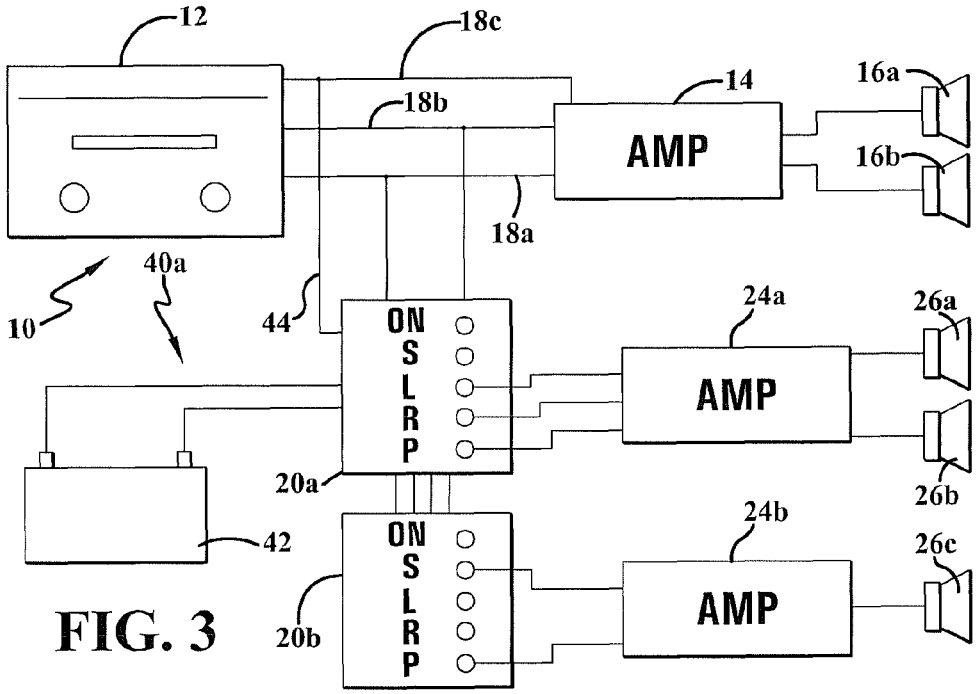
FIG. 3 is a schematic view showing an audio system having a plurality of supplemental output interfaces in accordance with still another embodiment of the present invention.

As shown in FIG. 3, a plurality of supplemental output interfaces 20*a*, 20*b* can be implemented in an audio system 10. Though only two are shown in the figure, it is to be appreciated that any number can be implemented without departing from the invention. These supplemental output interfaces can be located at various locations within the motor vehicle. For example, a first supplemental output interface 20*a* may be mounted underneath the dashboard to allow supplemental speakers to be mounted in the front area of the vehicle. A second supplemental output interface 20*b* may be mounted in the rear of the vehicle so as to allow supplemental speaker(s) 26*c* to be installed e.g. under the rear window of an automobile.

As indicated, each supplemental output interface 20*a*, 20*b* is preferably configured to supply audio signals and electrical power to a respective amplifier 24*a*, 24*b*. As illustrated in FIG. 3, the plurality of supplemental output interfaces 20*a*, 20*b* can be electrically connected in series, but they can also be electrically connected in parallel without departing from the invention.

In the audio system embodiments illustrated in FIGS. 1, 2, and 3, the supplemental output interface(s) 20 are electrically connected in parallel to the amplifier 14 and thus to the one or more primary external speakers 16*a*, 16*b*, 16*c*, 16*d*. In this way, the supplemental output interfaces provide one or more output speaker connections to one or more respective supplemental speaker(s) 26. However, as shown in the alternate embodiment of FIG. 4, a supplemental output interface 20*a* can be configured so that the one or more primary external speakers are directly connected (through an amplifier 14) to respective output speaker connections 18*a*, 18*b* of the supplemental output interface 20*a*.

In this way, it is understood that the primary factory installation includes removable connections rather than the traditional hard-wired connections. Thus, the original speakers and their wires can be easily removed and upgraded without requiring the vehicle owner to splice into the original wiring harness. This affords the vehicle owner with a modular audio system 10 that can be easily upgraded and customized, particularly if it is necessary to use a higher gage speaker wire for the upgraded speaker components.

The supplemental output interface 20*a* can include a plurality of output speaker connections 22*a*, 22*b*, 22*c* including some 22*a*, 22*b* that removably connect one or more external speakers 16*a*, 16*b* with an original factory installation (e.g. left and right channels, as illustrated). Also, one or more additional connections 22*c* can be provided that allow the connection of one or more supplemental speakers (e.g. a subwoofer 16*c* as illustrated). It should be appreciated that any number of output speaker connections 22*a*, 22*b*, 22*c* . . . could be provided from the supplemental output interface 20*a* in order to connect to any desired number of speakers, all without departing from the invention.

Figure 4:
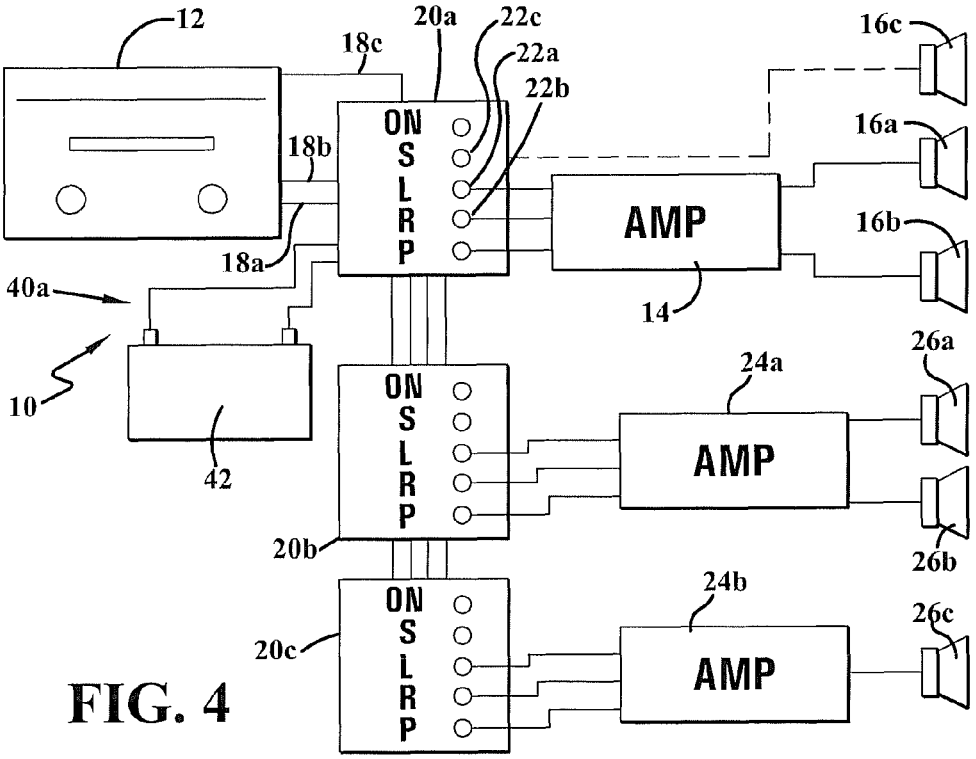
FIG. 4 is a schematic view depicting an audio system including a plurality of supplemental output interfaces, at least one of which is used to make primary speaker connections for the vehicle in accordance with yet another embodiment of the present invention.

As also shown in FIG. 4, a plurality of supplemental output interfaces 20*a*, 20*b*, 20*c* can be located in various locations throughout the vehicle, so as to obtain the benefits of the embodiment of FIG. 3. It should be appreciated that there is no limitation on the number of supplemental output interfaces that can be provided, nor is there any limitation on the number of output speaker connections from each supplemental output interface, and any such number or combination thereof could be implemented without departing from the invention.

Figure 6:
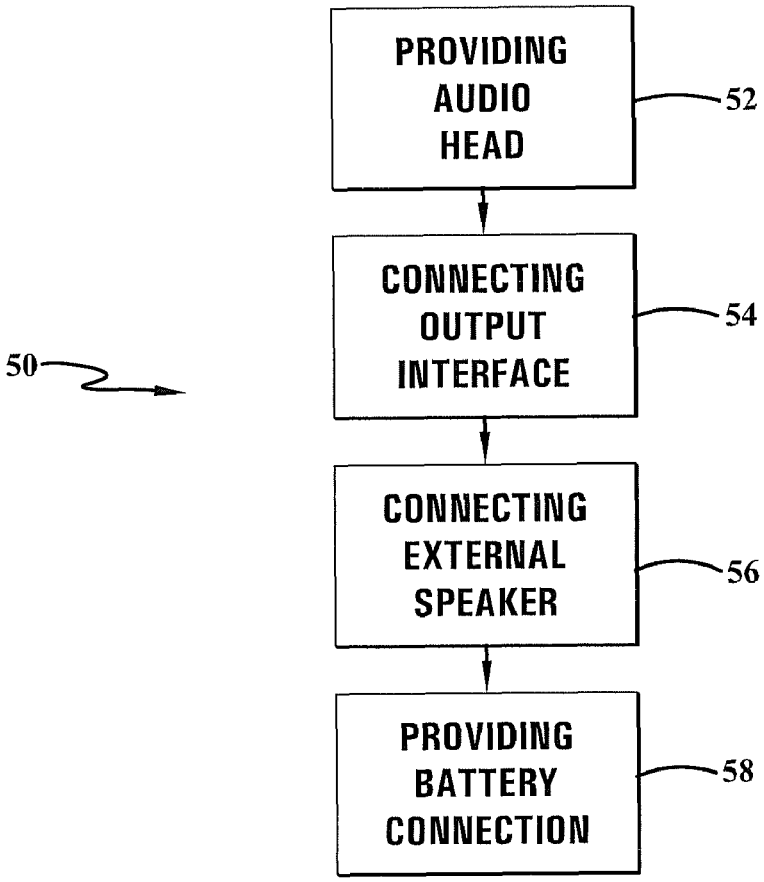
FIG. 6 is a flow chart illustrating a method of installing a supplemental output interface into an audio system of a motor vehicle, in accordance with the present invention.

Turning now to FIG. 6, a method 50 is disclosed of installing a supplemental output interface to an audio system for a motor vehicle. It should be appreciated that the supplemental output interface could be installed with the vehicle's audio system in the factory during vehicle manufacturing. However, the supplemental output interface could also be installed into an existing vehicle in an aftermarket upgrade procedure, all without departing from the present invention.

A step 52 is performed of providing an audio head unit in the motor vehicle for generating an audio signal. The audio head unit can be any suitable audio component such as a radio tuner for receiving radio signals. The audio head unit can also include a player for playing any recorded medium, such a compact disc player, an audio tape player, or a player for a digitally recorded audio file, such as an MP3 player or the like. The audio head unit can be initially installed in the vehicle during a manufacturing process, or can be retrofitted into an existing vehicle during an aftermarket installation.

A step 54 is performed of connecting a supplemental output interface to receive the audio signal. This step 54 can include splicing into a wiring harness of the audio head unit to establish an electrical connection for receiving the audio signal. Alternatively, this step can include making an electrical connection in parallel to a primary speaker, hard-wired to the audio head unit, so as to provide a removable output connection to one or more supplemental speakers.

A step 56 is performed of removably connecting an external speaker to the supplemental output interface. This step 56 can be implemented by providing an RCA plug/jack arrangement such that an RCA jack electrically connected to a suitable coaxial cable runs ultimately from a speaker and is inserted into an RCA plug in the supplemental output interface. However, it is to be appreciated that instead of using an RCA plug and corresponding jack, any suitable type of connector plug and jack, for coaxial or multiple lead cables, for analog or digital audio signals, could alternatively be employed, such as SMA, TRS, DIN, XLR, TOSLINK, HDMI, or the like, without departing from the invention.

A step 58 is performed of providing a battery connection for supplying electrical power to an amplifier from a vehicle battery. The battery connection can be established directly from the vehicle battery to the amplifier. However, the supplemental output interface can be configured to receive a battery connection and extend a power connection to the supplemental amplifier. In this manner, the supplemental amplifier is in series with the primary amplifier, and both can be turned off in unison.

It should be appreciated that the step 54 of connecting a supplemental output interface can include connecting a plurality of supplemental output interfaces. These supplemental output interfaces can be located at various locations within the motor vehicle, e.g. mounted underneath the dashboard to allow supplemental speakers to be mounted in the front area of the vehicle, or in the rear of the vehicle so as to allow supplemental speakers to be installed e.g. under the rear window of an automobile. This plurality of supplemental output interfaces can be electrically connected in series, but they can also be electrically connected in parallel without departing from the invention.

It should also be appreciated that the step 54 of connecting a supplemental output interface and the step 56 of removably connecting an external speaker to the supplemental output interface can be implemented by electrically connecting the supplemental output interface(s) in parallel to the primary amplifier and thus to the one or more primary external speakers, to provide connections to one or more respective supplemental speakers. However, the primary external speakers can be directly connected (through an amplifier) to the supplemental output interface, so as to provide a primary factory installation having removable connections rather than the traditional hard-wired connections. This allows removal and upgrading of the original speakers without requiring splicing into the original wiring harness, resulting in a modular audio system for a vehicle that can be easily upgraded and customized.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

I claim:

1. An audio system for a motor vehicle comprising:

an audio head unit that generates an audio signal;

a first external speaker that is mountable to the vehicle, receives the audio signal and produces an acoustic output within the motor vehicle;

a second external speaker that is mountable to the vehicle; and, a first supplemental output interface, that receives the audio signal through a hard-wired connection to the audio head unit, the first supplemental output interface comprising at least one output speaker connection, for providing a removable speaker connection to the second external speaker.

2. The audio system of claim 1, wherein the first supplemental output interface is electrically connected in parallel to the first external speaker.

3. The audio system of claim 1, wherein the first external speaker is directly connected to a second output speaker connection of the supplemental output interface.

4. The audio system of claim 3, wherein the second output speaker connection provides a removable speaker connection to the first external speaker.

5. The audio system of claim 1, further comprising at least one amplifier that receives the audio signal from the first supplemental output interface and sends an amplified signal to the second external speaker.

6. The audio system of claim 5, further comprising a battery connection for supplying electrical power to the at least one amplifier from a battery in the motor vehicle.

7. The audio system of claim 1, further comprising:

a third external speaker that is mountable to the vehicle; and, a second supplemental output interface, that receives the audio signal through a hard-wired connection to the first supplemental output interface, the second supplemental output interface comprising at least one output speaker connection, for providing a removable speaker connection to the third external speaker.

8. The audio system of claim 1, wherein the audio head unit comprises at least one of a radio tuner for receiving radio signals and a recorded medium player.

9. The audio system of claim 1, wherein the output speaker connection comprises a connector having a plug for receiving a corresponding jack, wherein the connector is selected from a group comprising RCA, SMA, TRS, DIN, XLR, TOSLINK, and HDMI connectors.

10. The audio system of claim 7, wherein the first supplemental output interface is mountable to a front area of the motor vehicle and the second supplemental output interface is mountable to a rear area of the motor vehicle.

11. A supplemental output interface for an audio system for a motor vehicle comprising first and second external speakers mounted to the vehicle and an audio head unit that generates an audio signal that is received by the first external speaker to produce an acoustic output, the supplemental output interface comprising:

means for receiving the audio signal from the audio head unit; and, at least one output speaker connection means, for removably connecting to the second external speaker and for sending the audio signal to the second external speaker to produce an acoustic output.

12. The supplemental output interface of claim 11, wherein the means for receiving the audio signal is electrically connected in parallel to the first speaker and hard-wired to the audio head unit.

13. The supplemental output interface of claim 11, further comprising:

at least one amplifier that receives the audio signal and sends an amplified signal to the second external speaker; and, a battery connection for supplying electrical power to the at least one amplifier from a battery in the motor vehicle.

14. The supplemental output interface of claim 11, wherein the output speaker connection means comprises a connector having a plug for receiving a corresponding jack, wherein the connector is selected from a group comprising RCA, SMA, TRS, XLR, TOSLINK, and HDMI connectors.

15. The supplemental output interface of claim 11, wherein the supplemental output interface is located within the motor vehicle at a location remote from the audio head unit.

16. A method of installing a supplemental output interface to an audio system for a motor vehicle comprising:

(A) providing the motor vehicle with a first external speaker mounted to the vehicle and an audio head unit that generates an audio signal that is received by the first external speaker to produce an acoustic output;

(B) connecting a supplemental output interface to receive the audio signal;

(C) mounting a second external speaker to the vehicle; and, (D) removably connecting the second external speaker to the supplemental output interface to produce an acoustic output.

17. The method of claim 16, wherein step (B) comprises the step of:

splicing into a wiring harness of the audio head unit to establish an electrical connection for receiving the audio signal.

18. The method of claim 16, wherein step (B) comprises the step of:

making an electrical connection in parallel to the first external speaker, hard-wired to the audio head unit, so as to provide a removable output connection to the second external speaker.

19. The method of claim 16, further comprising the steps of:

providing an amplifier that sends an amplified signal to the second external speaker; and, providing a battery connection for supplying electrical power to the amplifier from a vehicle battery.

20. The method of claim 16, wherein step (D) comprises the step of:

inserting a connector plug into a corresponding connector jack in the supplemental output interface, wherein the connector plug and jack are selected from a group comprising RCA, SMA, TRS, DIN, XLR, TOS LINK, and HDMI connectors.

* * * * *